US005862675A

United States Patent [19]

Scaringe et al.

[11] Patent Number: 5,862,675

[45] Date of Patent: Jan. 26, 1999

[54] ELECTRICALLY-DRIVEN COOLING/ HEATING SYSTEM UTILIZING CIRCULATED LIQUID

[75] Inventors: Robert P. Scaringe, Rockledge; Lawrence R. Grzyll; Steven D. Gann, both of Merritt Island, all of Fla.

[73] Assignee: Mainstream Engineering Corporation, Rockledge, Fla.

[21] Appl. No.: 866,255

[22] Filed: May 30, 1997

[51] Int. Cl.[6] ..... F25B 31/00

[52] U.S. Cl. ..... 62/193.3; 62/236; 62/237; 62/259.3; 165/46; 165/301

[58] Field of Search ..... 62/228.1, 228.4, 62/230, 196.1, 196.2, 196.3, 236, 259.3, 237; 165/301, 46, 302; 137/561 A, 884; 607/104, 108

[56] References Cited

U.S. PATENT DOCUMENTS 5,086,829 2/1992 Asakawa ..... 165/301

5,197,537 3/1993 Chigira et al. ..... 62/434

5,363,663 11/1994 Chen ..... 62/259.3

*Primary Examiner*—John M. Sollecito

*Attorney, Agent, or Firm*—Evenson, McKeown, Edwards & Lenahan, P.L.L.C.

[57] ABSTRACT

A system is adapted to be vehicle mounted and powered by a D.C. source coupled with an inverter to cool individuals or temperature sensitive hardware under uncomfortable ambient conditions. The system includes a pumped liquid circulation loop which can be connected by self-sealing lines with cooling garments, temperature sensitive hardware and the like. An evaporative heat exchanger is provided in the loop as well as a liquid reservoir which is sized to limit short cycling of a compressor in a refrigeration loop associated therewith via the evaporative heat exchanger. A hot gas bypass can be associated with the compressor to allow recirculation of the superheated refrigerant gas when cooling is not required.

20 Claims, 3 Drawing Sheets

ELECTRICALLY-DRIVEN COOLING/ HEATING SYSTEM UTILIZING CIRCULATED LIQUID

The U.S. Government may have certain license rights to the invention described and claimed herein pursuant to contract N60921-93C-A349 awarded by the U.S. Marine Corps Systems Command and the U.S. Navy Naval Surface Warfare Center, Dahlgren Division.

BACKGROUND AND SUMMARY OF THE INVENTION

The present invention relates to an electrically-driven vapor compression system which chills a liquid circulated through a garment to provide cooling for an individual or supplied to temperature sensitive hardware devices and is operable on vehicles and other field devices where only direct current (DC) electrical power is available. The present invention also relates to an electrically-driven system which heats a circulated liquid through a garment to supply heat to the individual.

There are many ways to cool and/or heat an individual exposed to uncomfortable ambient temperatures (i.e., cold or hot temperatures). Generally, these technologies fall into the categories of passive and active systems. Passive systems include the use of phase-change materials (PCMs), which act as energy storage devices, and adsorption cooling and/or heating systems, which use the endothermic/exothermic adsorption/desorption of a gas on a chemical or physical adsorbent to supply or absorb heat from the body. Active systems include active refrigeration systems using external power to mechanically cool the individual, and active heating systems using external power to supply heat to the individual.

In the past, cooling technologies adapted for individuals have used a PCM which melts to provide a constant-temperature heat sink for absorption of body heat. A PCM can also be used for heating, in where the PCM freezes at a constant temperature, providing a constant temperature heat source for supplying heat to the body. Although this approach works quite well, the weight penalty of this technology becomes prohibitive for cooling times greater than one to two hours. After the PCM is completely melted or frozen, this process must be reversed to regenerate the PCM for another use cycle. Thus, during this regeneration process, additional PCMs must be available to continue supplying the cooling/heating requirement, or the individual must cease the activity requiring cooling or heating. Regeneration and resupply of the PCM is not always practical, especially if the individual requiring cooling/heating is in the field.

Adsorption cooling and/or heating systems can have many different configurations, but typically utilize the endothermic desorption and exothermic adsorption of a vapor on an adsorbent bed to supply the cooling or heating. These systems also have weight and/or operational drawbacks. Once the adsorbent has reached its adsorption capacity, the adsorbent must be regenerated by driving off the adsorbed vapor (typically using heat), or the adsorbent must be replaced by new adsorbent. During this time period, the required cooling or heating must be supplied by a second (dual) system, or the individual must cease the activity requiring cooling or heating. Also, a regeneration system must be available. These characteristics present a significant weight penalty problem. Also, if the adsorbent is replaced, a supply of new adsorbent must be available and the spent adsorbent must be disposed of.

Active cooling/heating systems are practical only if the individual requiring the heating or cooling has access to power, such as on a motorized vehicle. For cooling, active refrigeration using vapor-compression technology has proven to be suitable. This technology uses a refrigeration-type compressor system to provide cooling; the compressor can be powered, for example, by combustion of fuel, batteries, or tethered external power. These systems have serious drawbacks, however. Compressors driven by fuel combustion are not hermetically sealed because of the shaft seal, and will lose refrigerant from this seal. From an environmental perspective, the loss of even HFC refrigerants into the environment is becoming more unacceptable. Compressors driven by batteries typically have DC motors with brushes to power the compressor. Because the sparks from DC motor brushes can cause degradation to the refrigerant and lubricant, these DC motor compressors cannot be hermetically sealed for this purpose, but are belt-driven or otherwise drive so as to require a shaft seal that will result in refrigerant leakage and increased maintenance. Compressors driven by tethered external power severely limit the portability of the system.

Active refrigeration systems using vapor-compression technology typically condition air and supply it to the individual by cooling the air surrounding the individual. Although these systems work well, they have several drawbacks for use by individuals who require heating or cooling in conditions where heating or cooling the air is not practical. Examples are individuals working in conditions that are open to the ambient atmosphere. Obviously, heating or cooling air which is open to the ambient is not practical due to the significant loss of the energy to the ambient. Also, because the individual breathes the air, filtration is typically required to remove particles, dust, and contaminants, and in military applications, to remove chemical or biological contaminants.

Systems which cool water which is then supplied to the wearer are also known in the art. In such systems, the wearer is cooled by direct contact heat transfer with a garment (vest, pants, cap, etc.) which contains flexible plumbing lines or a bladder incorporated into the garment. A chilled liquid, typically water/antifreeze solution, is pumped through this garment and thereby cools the wearer. It is also known in the art to use thermoelectric devices to cool the liquid which is supplied to the wearer. For heating, electrical heating systems can be used to heat the air surrounding the individual or heat a liquid that is supplied to the individual. Alternatively, heat resulting directly or indirectly from fuel combustion can be used to heat the air or liquid surrounding the individual. The use of thermoelectric devices to provide cooling has several drawbacks. First, thermoelectric devices are inherently inefficient and require considerable amounts of power to provide cooling or heating. Second, the reliability and life of thermoelectric devices is a cause for concern.

It is an object of the present invention to provide an electrically-driven, portable apparatus which produces the desired cooling or heating of an individual working in uncomfortable ambient conditions with access to DC power. Cooling is accomplished using vapor compression refrigeration to cool a circulating liquid loop in thermal communication with the body. The system is operable on vehicles or other field devices where electric power is available and portability is essential. The unit is thus configured with an inverter to provide the required alternating current (AC) power to the compressor. The system can also be configured to provide heat to the body by supplying heated liquid instead of cooled liquid. The cool liquid can also be directed to cold plates to cool avionics or other temperature sensitive electronics or hardware.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
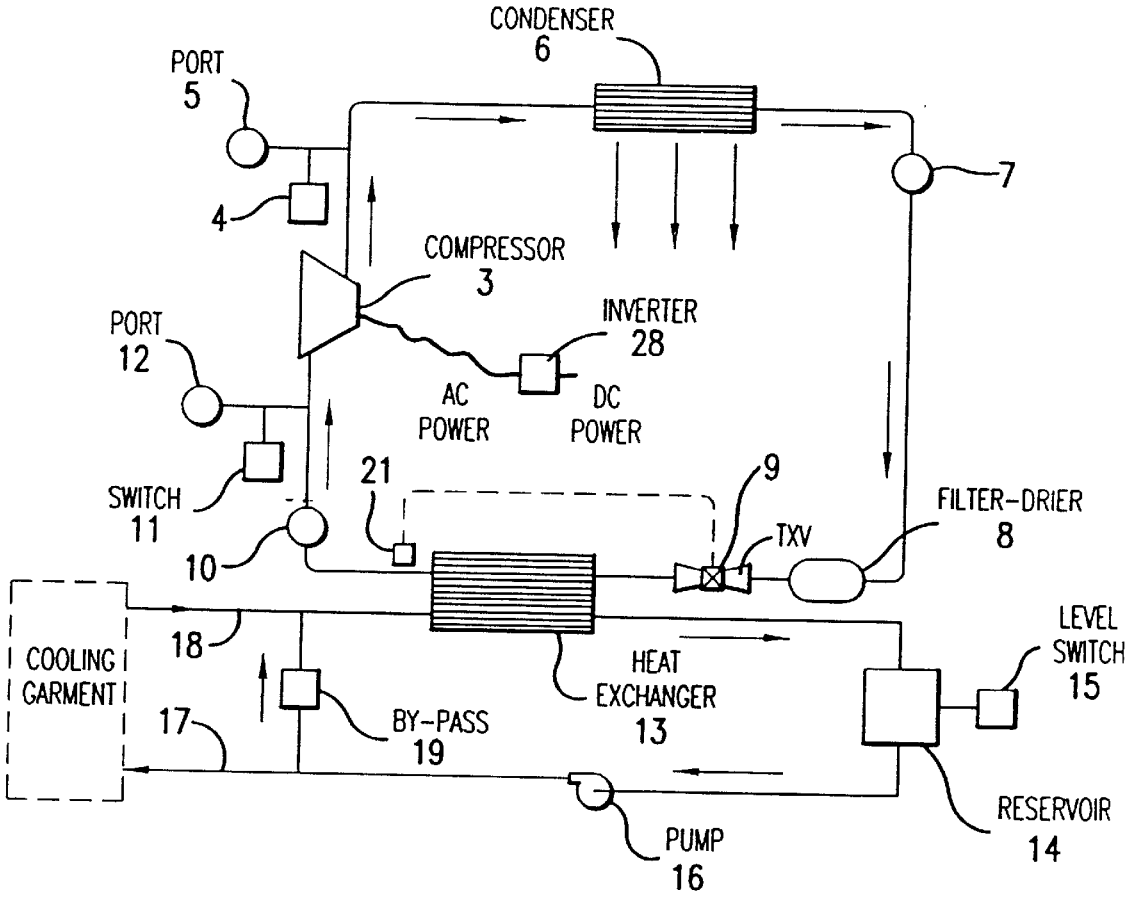
FIG. 1 is a schematic diagram of a system in accordance with the present invention in which a liquid circulation system and a compression system provide heated or chilled liquid for heating or cooling.

In FIG. 1, the apparatus A provides chilled liquid or heated liquid for individual vest cooling or cooling of temperature sensitive hardware devices and has two main sections, namely the liquid circulation system B and the vapor compression system C.

The liquid circulation system B is a liquid (typically water or water/glycol mixture) pumped loop which supplies the cooling or heating fluid to the individual garments or cold plates in a known way (not shown). This pumped loop consists of a heat exchanger 13 (refrigerant two-phase to liquid single-phase), a liquid reservoir 14, with a liquid level shut-off switch 15, a liquid pump 16, automatic bypass 19, a self-sealing liquid supply connection 17, and a self-sealing liquid return connection 18. The garment or cold plate is typically located between the self-sealing liquid supply connection 17 and the self-sealing liquid return connection 18. The liquid supply and return lines 17, 18 are self-sealing to avoid the loss of liquid coolant when the garment or cold-plate is disconnected from the unit. The bypass 19 is necessary to allow a recirculation loop when the unit is disconnected at the lines 17, 18. In this way, the pump 16 can continue to operate and the fluid in the reservoir is pumped through the heat exchanger 13.

The temperature is controlled at the reservoir 14 which contains the largest quantity of cooling fluid, and the thermal mass of this fluid is beneficially used to prevent short-cycling of the refrigeration compressor. If only the temperature of the fluid at the exit to the heat exchanger 13 is controlled, greater temperature variations occur which leads to increased short-cycling, shorter compressor life and increased load on the inverter. The volume of the reservoir 14 is sized so that the compressor duty cycle or operating time (on-time) is sufficient to avoid short-cycling even if the cooling garments or cold plates are disconnected. The reservoir 14 contains a conventional Liquid Level Shut-off switch (15) to prevent the unit from operating without sufficient liquid in the loop, thus protecting the liquid pump 16 and the refrigeration circuit the event of a leak.

The refrigeration portion C of the apparatus A evaporates refrigerant at low pressure in the evaporative heat exchanger 13, thereby drawing heat from the liquid being cooled. Superheated refrigerant leaves the evaporative heat exchanger 13. The amount of superheat is controlled by an expansion device, such as a thermostatic expansion device (TXV) 9, by way of the temperature sensor 21. Other known types of expansion devices can also be used. A sight glass 10 is provided in the circuit to verify that all the refrigerant has been vaporized and to aid in diagnostics and system charging. Refrigerant from the evaporator 13 is compressed in a compressor 3 and then enters an air or water cooled condenser 6 where the refrigerant is cooled and condensed. If the condenser is air cooled a fan is used to force air over the condenser. The refrigerant exits the condenser and passes through a second sight glass 7. Again this optional sight glass is used to verify that the refrigerant stream is all liquid.

The presence of any vapor bubbles in the sight glass 7 indicates that the system is undercharged with refrigerant or that non-condensable gases are present in the system. The liquid refrigerant leaves the sight-glass 7 and enters a refrigeration filter-drier 8 which adsorbs moisture and acid in the system and filters out hard particles. This filter 8 is located just prior to or upstream of the expansion valve 9 to avoid clogging the very small passage diameter of the latter. High-side 5 and low-side 12 refrigerant service ports are included for servicing the unit, and high-side pressure switch 4 and low-side pressure switch 11 are provided to shut-down the system if the pressure becomes too high (as a result of a clogged expansion valve 9 or high ambient temperature) or too low (indicating a lack of refrigerant in the system).

The present invention contemplates allowing for heat transfer between the refrigerant leaving the evaporator and refrigerant leaving the condenser 6 via a heat exchanger in a known manner or merely placing the refrigerant lines in thermal communication with each other to thereby lower the enthalpy of refrigerant entering the evaporator 13 to increase the system capacity and efficiency. In one embodiment, the heat exchanger 13 can be a coiled coaxial heat exchanger to reduce space. To eliminate the need for insulation, the heat exchanger can be located inside the liquid reservoir which is already insulated. This approach also increases the heat transfer area for heat transfer to the liquid, thereby making the heat exchanger more effective.

The above described invention has the particular and unique advantage of being operable on vehicles and other field devices where 12, 24, or even 48 volts direct current (VDC) is commonly available and 120 volts alternating current (VAC) is typically unavailable. A hermetic (or semi-hermetic) compressor is necessary to increase the reliability and maintainability of the system, because a non-hermetic compressor will lose refrigerant from the shaft seal, significantly reducing the reliability and resulting in additional service to add refrigerant. From an environmental perspective, the loss of even HFC refrigerants into the environment is rapidly becoming unacceptable. Hermetically (or semi-hermetic) sealed 12, 24 or 48 VDC compressors are not, however, commercially available. To solve this problem, we have found that the unit used in the present invention can be advantageously equipped with an inverter 28 to provide 120 VAC from the low voltage DC electric power. The inverter must be cooled either by air or by the chilled fluid produced by the unit. Using chilled liquid substantially reduces the size of the inverter, as opposed to air cooling, and is practical when size is an issue. A combination of both cooling methods can also be used, i.e. air cooling of components which are not temperature sensitive (but still require cooling) and chilled liquid cooling of the sensitive components. The vapor compression system C will operate on any refrigerant capable of evaporation and condensation at reasonable pressures for the operating temperatures being used.

Figure 2:
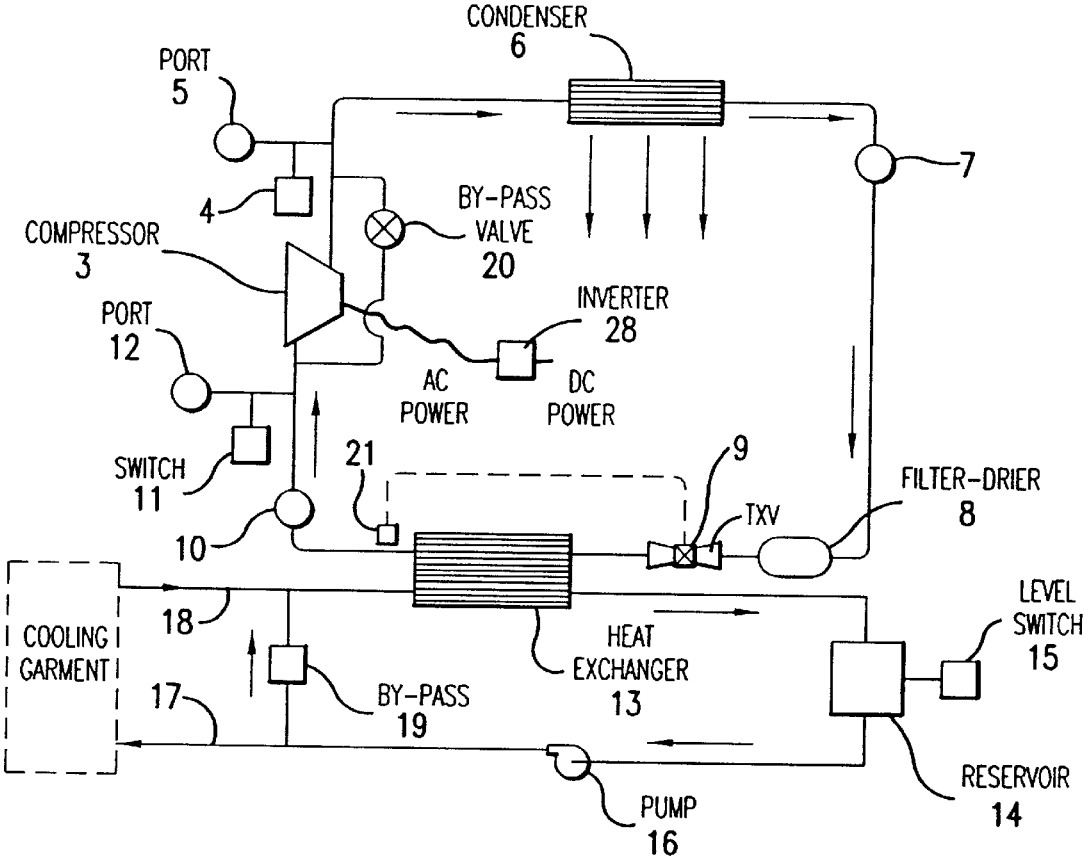
FIG. 2 is a schematic diagram of another embodiment of a system in accordance with the present invention wherein a hot gas bypass provides for continuous compressor operation.

Another embodiment A' of the present invention is shown in FIG. 2 (wherein like numerals describe like parts) wherein the refrigeration system C' includes a hot gas bypass which allows the compressor 3 to operate continuously. Because the start-up current of an electric motor is significantly larger than the operating current, the additional stresses on the inverter are avoided by optionally operating the compressor 3 continuously with the cooling system capacity modulated using the hot-gas bypass in the form of a solenoid valve 20. When cooling is no longer needed, the solenoid valve 20 is opened, thereby allowing hot gas to by-pass from the compressor high-side to the low side and shutting off cooling without stopping the compressor 3. With the compressor in continuous operation, concern over short cycling and start-up current surges on the inverter are minimized. Also, by using the by-pass solenoid valve 20 in concert with an intelligent controller, such as a PID controller, the by-pass circuit can be activated frequently to provide very tight thermal control without overloading the inverter due to the start-up current or the compressor 3 due to the higher motor heat during start-ups. Without the bypass 20, frequent start-ups (short-cycling) could shorten the life of either the compressor 3 or the inverter 28, thus requiring the a larger fluid reservoir to avoid compressor short-cycling.

Figure 3:
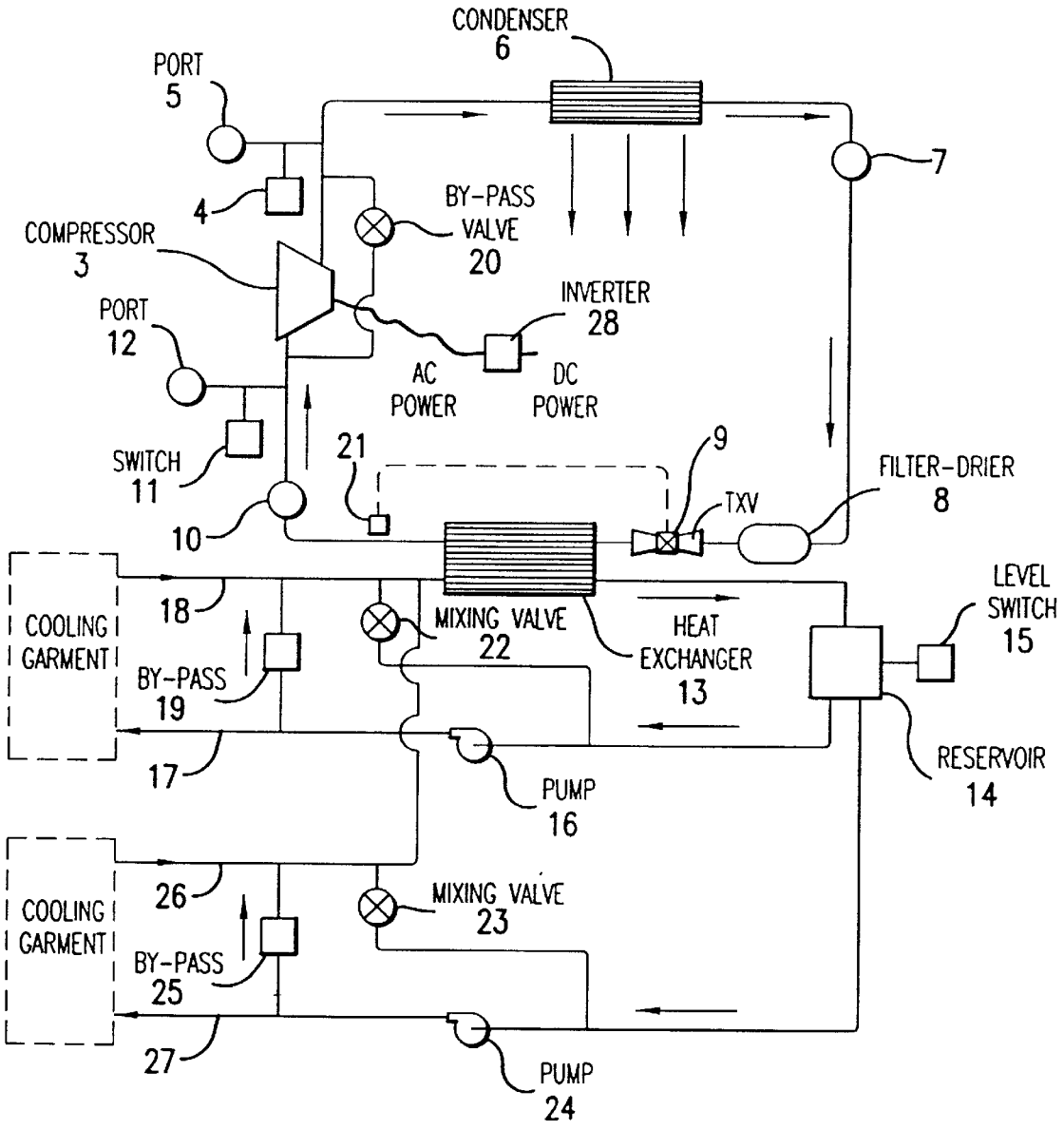
FIG. 3 is a schematic diagram of another embodiment of a system in accordance with the present invention wherein the system is configured to provide heating or cooling to more than one individual.

Another embodiment A" of the present invention is shown in FIG. 3 (like numerals again describing like parts) wherein the refrigeration system is configured to cool more than one individual, with each individual having independent control of the liquid coolant temperature. In this embodiment the liquid circulation system consists of a heat exchanger 13 (refrigerant two-phase to liquid single-phase), a liquid reservoir 14, a liquid level shut-off switch 15, liquid pumps 16 and 24, pressure-relief bypasses 19 and 25, self-sealing liquid supply connections 17 and 27, and self-sealing liquid return connections 18 and 26. The temperature of the coolant liquid is controlled at the reservoir by the refrigeration subsystem C". Individual temperature control is achieved using bypass solenoid mixing valves 22 and 23. These valves provide individual temperature control to each of the garments by mixing chilled liquid from the reservoir with warm liquid returning from the garment.

Although the invention has been described and illustrated in detail, it is to be clearly understood that the same is by way of illustration and example, and is not to be taken by way of limitation. The spirit and scope of the present invention are to he limited only by the terms of the appended claims.

We claim:

1. A portable arrangement adapted to be vehicle-mounted for cooling and heating living persons and things in uncomfortable ambient conditions, comprising a liquid circulation system configured to be operatively connected with at least one cooling garment device and including an evaporative heat exchanger;

a vapor compression refrigeration system operatively associated with the liquid circulation system via the evaporative heat exchanger; and an inverter and DC power source operatively associated with the liquid circulation system and the refrigeration system.

2. The arrangement according to claim 1, wherein the liquid circulation system further comprises a pump and a reservoir operatively connected with the pump and the evaporative heat exchanger.

3. The arrangement according to claim 2, wherein a recirculation bypass is arranged between the pump and the evaporative heat exchanger when the cooling garment device is disconnected from the liquid circulation system.

4. The arrangement according to claim 2, wherein a liquid-level shut-off switch is associated with the reservoir so as to assure adequate liquid in the liquid circulation system.

5. The arrangement according to claim 1, wherein self-sealing supply and return lines provide the operative connection between the liquid circulation system and the cooling garment device.

6. The arrangement according to claim 1, wherein the refrigeration system includes a condenser and a hermetically sealed compressor operatively associated with the condenser and the evaporative heat exchanger.

7. The arrangement according to claim 6, wherein the liquid circulation system further comprises a pump and a reservoir operatively connected with the pump and the evaporative heat exchanger.

8. The arrangement according to claim 6, wherein an expansion valve is operatively arranged between the condenser and the evaporative heat exchanger.

9. The arrangement according to claim 8, wherein the liquid circulation system further comprises a pump and a reservoir operatively connected with the pump and the evaporative heat exchanger.

10. The arrangement according to claim 9, wherein a recirculation bypass is arranged between the pump and the evaporative heat exchanger when the cooling garment device is disconnected from the liquid circulation system.

11. The arrangement according to claim 10, wherein a liquid-level shut-off switch is associated with the reservoir so as to assure adequate liquid in the liquid circulation system.

12. The arrangement according to claim 11, wherein self-sealing supply and return lines provide the operative connection between the liquid circulation system and the cooling garment device.

13. The arrangement according to claim 6, wherein a high side pressure switch is located at an outlet of the compressor, and a low side pressure switch is located at an inlet of the compressor.

14. The arrangement according to claim 6, wherein a bypass is arranged at the compressor to selectively bypass hot gas from a compressor high side to a compressor low side during a non-cooling period.

15. The arrangement according to claim 14, wherein the liquid circulation system further comprises a pump and a reservoir operatively connected with the pump and the evaporative heat exchanger.

16. The arrangement according to claim 15, wherein an expansion valve is operatively arranged between the condenser and the evaporative heat exchanger.

17. The arrangement according to claim 16, wherein a recirculation bypass is arranged between the pump and the evaporative heat exchanger when the cooling garment device is disconnected from the liquid circulation system.

18. The arrangement according to claim 17, wherein a liquid-level shut-off switch is associated with the reservoir to assure adequate liquid in the liquid circulation system.

19. The arrangement according to claim 18, wherein self-sealing supply and return lines provide the operative connection between the liquid circulation system and the cooling garment device or the temperature-sensitive apparatus.

20. The arrangement according to claim 1, wherein the liquid circulation system is provided with a plurality of pumps, a reservoir operatively connected with the pumps and the evaporative heat exchanger, and bypasses operatively arranged between the evaporative heat exchanger and respective ones of the pumps.

* * * * *